US006527044B2

(12) United States Patent
Mangold

(10) Patent No.: US 6,527,044 B2
(45) Date of Patent: Mar. 4, 2003

(54) HEAT EXCHANGER ASSEMBLY

(75) Inventor: Rainer Mangold, Kirchheim (DE)

(73) Assignee: Modine Manufacturing Company, Racine, WI (US)

( * ) Notice: Subject to any disclaimer, the term of this patent is extended or adjusted under 35 U.S.C. 154(b) by 18 days.

(21) Appl. No.: 09/757,196

(22) Filed: Jan. 9, 2001

(65) Prior Publication Data

US 2001/0013405 A1 Aug. 16, 2001

(30) Foreign Application Priority Data

Jan. 22, 2000 (DE) ..... 100 02 745

(51) Int. Cl.[7] ..... F28F 9/00

(52) U.S. Cl. ..... 165/67; 165/140; 165/81; 180/68.4

(58) Field of Search ..... 165/67, 140, 81, 165/76; 180/68.4

(56) References Cited

U.S. PATENT DOCUMENTS

| | | | | | |
|---|---|---|---|---|---|
| 4,540,044 | A | * | 9/1985 | Lenz | 165/67 |
| 5,139,080 | A | | 8/1992 | Bolton et al. | 165/67 |
| 5,219,016 | A | * | 6/1993 | Bolton et al. | 165/140 |
| 6,158,500 | A | * | 12/2000 | Heine | 165/140 |
| 6,181,556 | B1 | * | 1/2001 | Allman | 165/185 |
| 6,202,737 | B1 | * | 3/2001 | Mahe | 165/140 |

FOREIGN PATENT DOCUMENTS

| | | |
|---|---|---|
| DE | 2018459 | 11/1971 |
| DE | 2557967 | 6/1977 |
| DE | 3814007 | 4/1989 |
| DE | 19857494 | 7/1999 |
| DE | 19857512 | 7/1999 |
| DE | 19909942 | 9/2000 |
| EP | 046566 | 9/1982 |
| FR | 2773903 | 3/2000 |

* cited by examiner

*Primary Examiner*—Leonard Leo
(74) *Attorney, Agent, or Firm*—Wood, Phillips, Katz, Clark & Mortimer

(57) ABSTRACT

An assembly of two heat exchangers is readily formed or disassembled using spring clips to hold the two heat exchangers in assembled relation. The arrangement is such that the spring clips do not exert undesirable tension or compressional forces against either of the cores of the heat exchangers, but rather, exert only torsional forces at the points of connection.

2 Claims, 1 Drawing Sheet

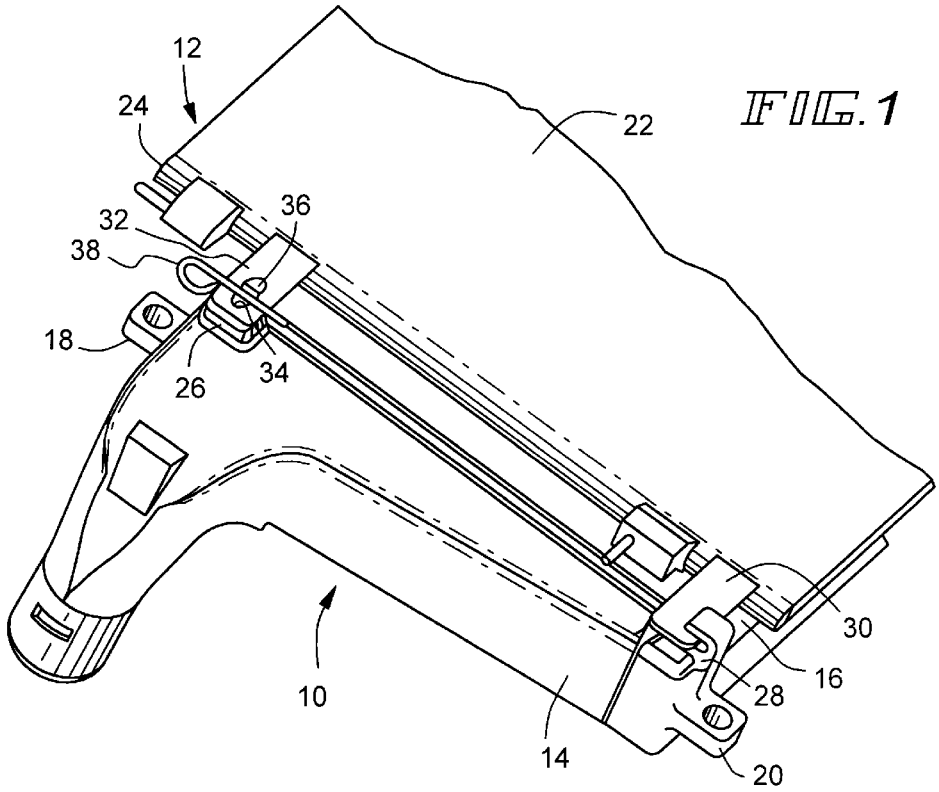
FIG. 1
FIG. 3
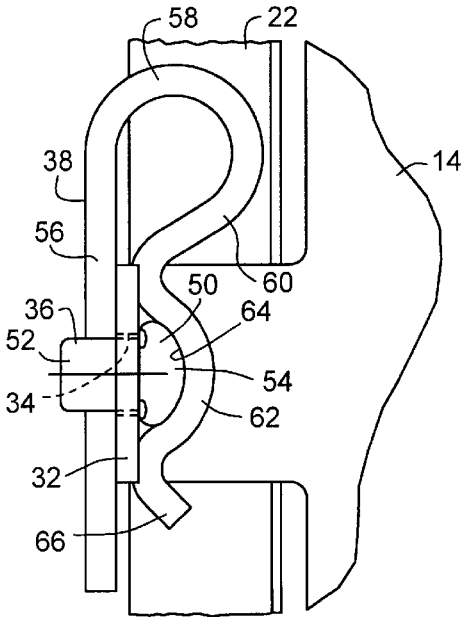
FIG. 2
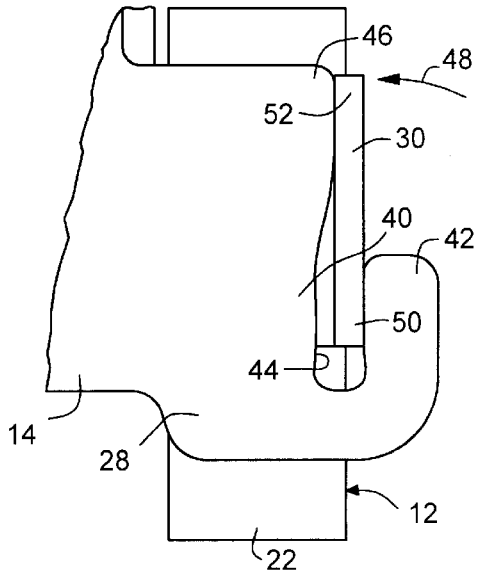

HEAT EXCHANGER ASSEMBLY

FIELD OF THE INVENTION

This invention relates to heat exchangers, and more particularly, to an assembly of two heat exchangers which is such that assembly of the heat exchangers to each other or the disassembly of the two connected heat exchangers is easily effected.

BACKGROUND OF THE INVENTION

Many applications involving heat exchangers require the assembly of two or more heat exchangers together such that a common heat exchange fluid passes through both heat exchangers serially. A common example is the heat exchanger system of a vehicle. In such systems, the heat exchange fluid common to plural heat exchangers that is customarily employed is air and heat exchanger components of many systems are located in the forward part of the vehicle frame to receive air which is either drawn or propelled through the heat exchanger by a fan or passes through the heat exchanger as a result of ram air effects. Not untypically, the heat exchangers may include radiators for cooling engine coolant, charge air coolers for cooling combustion compressed by a turbocharger or a super charger prior to being directed to the engine, condensers for air conditioning systems, etc.

These heat exchangers are assembled together in close proximity when installed in the vehicle because of space constraints in the engine compartment in which the heat exchangers are normally disposed. Further, the heat exchangers are located in close proximity to one another so as to allow for a minimal frontal area that in turn allows the designer of a vehicle to achieve a more aerodynamically slippery effect to promote fuel economy.

While these practices most certainly are beneficial, they are not without one undesirable side effect. Specifically, when one of the heat exchangers requires servicing, as for example, in repairing a leak or when the heat exchanger requires complete replacement, it is often difficult to achieve easy access to the affected heat exchanger to cause its removal for replacement or repair.

In an attempt to avoid this problem, German patent document 19857508A1 discloses a construction wherein lower struts of one heat exchanger are inserted into lower supports on another heat exchanger. The first heat exchanger is then pressed such that upper struts thereon snap into upper spring clasps. The spring clasp is a specially produced part, and thus expensive. It is mounted with a leg on a sleeve formed on the tank of the second heat exchanger such that the other leg exerts a vertical force on the upper and lower struts of the first heat exchanger and on the core of the first heat exchanger. Unfortunately, the core of the first heat exchanger, which typically consists of relatively thin-walled flat tubes and corrugated fins is placed under compression. Over time, this may lead to failures at various joints.

Other proposals in which spring clips are used as fastening elements in heat exchangers include DE-OS-2018459, EP0046566B1, DE-AS2557967, DE3814007C1, DE19857512A1 and DE19857494A1. Various disadvantages attend the use of these structures as well with the consequence that there remains a real need for a heat exchanger assembly held together by spring clips to permit ease of assembly and disassembly without the disadvantages of the prior art constructions. In particular, there remains a need for such an assembly wherein compressive forces on the core of one of the heat exchangers can be avoided without having a significant adverse affect on the desired goal to effect simple assembly and disassembly of the heat exchanger construction.

SUMMARY OF THE INVENTION

It is the principal object of the invention to provide a new and improved assembly of two heat exchangers wherein the two may be held in assembled relation by a removable spring clip without exerting undesirable forces on either of the heat exchangers.

An exemplary embodiment of the invention achieves the foregoing object in an assembly that includes a first heat exchanger having a core through which a coolant may pass and elongated, generally vertical, spaced tanks in fluid communication with the core. A second heat exchanger is provided with a core with elongated spaced tanks flanking the core. A support is disposed on each of the tanks of the first heat exchanger at a lower part thereof and a mount is disposed on each of the tanks of the first heat exchanger at an upper part thereof. Two spaced lower struts are located on the second heat exchanger and are received in respective ones of the supports. In addition, two spaced upper struts are located on the second heat exchanger aligned with respective ones of the mounts. A removable spring clip secures each of the upper struts to the mount with which it is aligned and imparts a torsional stress to the struts.

As a result of this construction, undesirable compressive or tensional stresses on one or the other of the heat exchangers is avoided while a tight assembly is maintained as a result of the torsional stress.

In a preferred embodiment, each of the upper mounts includes a pin directed toward the second heat exchanger and each upper strut includes a slot loosely receiving the pin on the associated upper mount. Each spring clip is a hairpin cotter key having one leg abutting the corresponding upper strut and another leg abutting the pin on the associated mount oppositely of the corresponding upper strut.

A preferred embodiment contemplates that the one leg of the hairpin cotter key is straight and the other leg includes a concave surface receiving the pin. The pin, at its point of abutment with the other leg of the hairpin cotter key has a convex surface received within the concave surface on the cotter key.

A preferred embodiment contemplates that the supports be J-shaped having a short leg and a long leg opening upwardly. The long leg, at a location remote from the short leg, has a protrusion extending toward the short leg and engaging the associated lower strut.

Preferably, the tanks, the mounts, the struts and the supports are formed of aluminum.

A highly preferred embodiment contemplates that the struts are brazed to the second heat exchanger tanks and that the mounts and the supports are cast in the first heat exchanger tanks.

Other objects and advantages will become apparent from the following specification taken in connection with the accompanying drawings.

DESCRIPTION OF THE DRAWINGS

FIG. 1 is a fragmentary, perspective view of a heat exchanger assembly made according to the invention;

FIG. 2 is an enlarged, fragmentary elevation of a lower support construction employed in an embodiment of the invention; and FIG. 3 is an enlarged, fragmentary, elevation of an upper mount and spring clip assembly employed in the invention.

DESCRIPTION OF THE PREFERRED EMBODIMENT

While the invention will be described in connection with the assembly of two specific heat exchangers, namely, a charge air cooler and a condenser, the invention is applicable to the assembly of other types of heat exchangers to one another. For example, the assembly could include a radiator and/or an oil cooler connected to each other or to a condenser or a charge air cooler. Thus, no limitation to an assembly of a condenser and a charge air cooler is intended except insofar as expressly stated in the appended claims.

With the foregoing in mind, and with reference to FIG. 1, the assembly includes a charge air cooler, generally designated 10, to which a condenser, generally designated 12, is assembled. The charge air cooler includes a pair of spaced tanks 14 (only one of which is shown) which are fitted to header plates (not shown) on opposite sides of a core 16. In the usual case, the tanks 14 are elongated and will extend vertically and the core 16 will be composed of a plurality of tubes in spaced relation provided with plate or serpentine fins extending between the tubes. The interior of the tubes will be in fluid communication with the tanks 14.

Typically, each tank 14 will be formed by casting and will be cast of aluminum. Each tank 14 may include upper and lower mounting eyes 18, 20, respectively by which the assembly may be secured to the frame or other parts of a vehicle, usually at the front end of the engine compartment thereof.

The condenser 12 includes a core 22 extending between tubular headers 24 (only one of which is shown). Flattened tubes having a relatively small hydraulic diameter extend between the headers 24 and are in fluid communication therewith. Serpentine fins, or in some instances plate fins, will be employed on the tubes in a customary fashion. Refrigerant inlet and outlet connections (not shown) will be associated with one or the other or both of the headers 24. Again, the components of the condenser 12 will typically be formed of aluminum although other materials may be used if desired.

The tanks 14, near their upper ends, include integrally formed mounts 26 (only one of which is shown). The mounts 26 will be described in greater detail hereinafter.

Near the lower ends of each of the tanks 14, supports 28 are integrally formed as well. That is to say, the mounts 26 and the supports 28 will be integrally cast into the tank 14 as it is being formed.

The condenser 12, near its lower end, includes outwardly directed struts 30 (only one of which is shown) and which are operatively received in a corresponding one of the supports 28 on a corresponding one of the tanks 14 of the charge air cooler 10. Similarly, upper struts 32 (only one of which is shown) extend from the core of the condenser 12 for connection to the mounts 26 on the tanks 14 of the charge air cooler 10. In the usual case, the struts 30 and 32 will be provided with saddle mounts of a conventional form and brazed to a corresponding one of the headers 24 of the condenser 12 as is well known.

The upper struts 32 each include a slot 34 which loosely receives a pin 36 formed on the corresponding mount 26 for purposes to be seen. A conventional hair pin cotter key 38 serves as a spring clip for securing the struts 32 to the corresponding one of the mounts 26.

Turning now to FIG. 2, each support 28 is generally J-shaped having a long leg 40 and a short leg 42 which together define an upwardly opening slot 44. Near its upper end, the long leg 40 includes a protuberance 46 that extends toward the short leg 44, that is, in the direction of the strut 30. This protuberance is, as is evident from FIG. 2, located on the long leg 40 at a location remote from the short leg 42. As a consequence of this construction, when assembling the condenser 12 to the charge air cooler 10, the lower struts 30 may be introduced into the slots 44 with the core 22 at a slight angle to the vertical. The upper end of the core 22 is then moved in the direction of an arrow 48 to a position approximately parallel to the core 16 of the charge air cooler. Thus, a lower side 50 of each lower strut 30 is engaged with the short leg 44 while an upper side 52 is engaged with the protuberance 46. The opening 44 and the protuberance 46 are constructed so that the aforementioned engagement occurs just before the core 22 reaches parallelism with the core 16. As a result, when the core 22 is urged just slightly closer to parallel, a torsional force will be imparted to the struts 30. It is important to note that this force is applied to the struts 30 and not to the core 22 of the condenser 12. In all events, the struts 30 are tightly held within the mount 28 as a result.

Turning now to FIG. 3, the structural arrangement of the components assembling the upper strut 32 to the mounts 26 is illustrated in greater detail. The pin 36 is seen to pass through the slot 34. The pin 36 is integrally formed on the mount 26 and has an enlarged side 50 adjacent to header 14 and a projecting side 52 which enters the slot 34 and which is directed away from the tank 14. The enlarged side 50 thus serves as a backing against which the upper struts 32 abut. Moreover, the enlarged side 52 includes, on its surface facing the tank 14, a convex or curved surface 54.

The hair pin cotter key 38 includes a straight leg 56 connected at one end by a loop 58 to a corrugated or serpentine leg 60. The leg 60 includes a curved section 62 having a surface 64 facing the pin 36 that is concave and shaped to conform to the convex surface 54. In addition, the end of the leg 60 terminates at end 66 that extends away from the straight leg 56. The end 66 allows the legs 56 and 60 to be cammed apart when the hair pin cotter key 38 is being installed.

It will be recalled from the description of FIG. 2 that the upper end of the core 22 is pivoted toward the core 16, and this is done when the upper struts 32 and the slot 34 therein are aligned with the projections 58 of the pins 36. The pivoting action takes place until the upper struts 32 abut the enlarged part 50 of the pin 36 with the projections 52 entering the slots 34. At this time, the cotter key 38 may be slipped over the assembly with the straight leg abutting the corresponding upper strut 32 and with the serpentine leg fitted about the enlarged part of the pin 50 such that its concave surface 64 receives the convex surface 54 of the pin 50.

In this position, the desired torsional force in the struts is realized without the impartation of any compression or tension forces in either of the heat exchangers. The cotter key provides resilience to the connection so that the torsional forces cannot exceed those applied to the assembly by the interaction or squeezing action of the legs 56, 60. The loose fit of the projection 52 in the slot 34 allows thermal expansion and contraction without inducing stresses in the assembly and the forces involved are sufficient to assure a tight connection of the two heat exchangers together without fear of rattling or the like. Disassembly is readily achieved simply by removing the cotter keys 38 by grasping the loops 58 and exerting an upward removing force, thereby removing the cotter keys 38. A slight tipping of the core 22 away from the charge air cooler 14 to relieve the torsional force on the lower struts 30 is all that is required to free the condenser 12 from the assembly, allowing it to be removed simply by pulling upwardly on it after refrigerant line connections have been removed.

Thus, the invention achieves its object of providing a readily assembled and disassembled assembly of two heat exchangers through the use of spring clips without causing undesirable tension or compression forces to be exerted against the cores.

I claim:

1. An assembly of two heat exchangers, comprising a first heat exchanger having a core through which a coolant may pass and elongated, generally vertical spaced tanks in fluid communication with said core;

a second heat exchanger having a core with elongated spaced tanks flanking the core;

a support on each of the tanks of said first heat exchanger at a lower part thereof;

a mount on each of the tanks of said first heat exchanger at an upper part thereof;

two spaced lower struts on said second heat exchanger received in a respective one of said supports;

two spaced upper struts on said second heat exchanger aligned with respective ones of said mounts; and a removable spring clip securing each of said upper struts to the mount with which it is aligned and imparting a torsional stress to said struts;

each said upper mount including a pin directed toward said second heat exchanger and each said upper strut including a slot loosely receiving the pin on the associated upper mount; and each said spring clip being a hair pin cotter key having one leg abutting the corresponding upper strut and another leg abutting the pin on the associated mount oppositely of the corresponding upper strut.

2. The assembly of claim 1 wherein said one leg is straight and said another leg includes a concave surface receiving said pin, said pin, at its point of abutment with said another leg having a convex surface received within said concave surface.

* * * * *